United States Patent [19]

Zamansky et al.

[11] 3,970,117

[45] July 20, 1976

[54] TWISTER FOR WIRE TIES

[76] Inventors: Asher Z. Zamansky, 33 Cottage St.; Hyman H. Zamansky, 114 Cottage St., both of Chelsea, Mass. 02150

[22] Filed: July 14, 1975

[21] Appl. No.: 595,520

[52] U.S. Cl. ..... 140/93 A; 140/119; 140/57

[51] Int. Cl.[2] ..... B21F 15/04

[58] Field of Search ..... 140/56, 57, 115, 119, 140/122, 93 A; 310/47, 50; 320/2; 200/61.58 R, 61.85; 318/17, 446

[56] References Cited

UNITED STATES PATENTS

| | | | |
|---|---|---|---|
| 1,436,637 | 11/1922 | Bates | 140/119 |
| 3,343,192 | 9/1967 | Goldstein et al. | 310/50 |
| 3,471,662 | 10/1969 | Berchtold | 200/61.58 R |
| 3,677,308 | 7/1972 | Sarff et al. | 140/93 A |

FOREIGN PATENTS OR APPLICATIONS

| | | | |
|---|---|---|---|
| 557,442 | 2/1957 | Italy | 140/118 |

*Primary Examiner*—Lowell A. Larson

[57] ABSTRACT

A hand held, portable assembly for wire tying which contains, in a handle, an electric motor arranged to turn a forwardly deployed hook which twists a wire tie with which the hook is engaged.

8 Claims, 3 Drawing Figures

TWISTER FOR WIRE TIES

INTRODUCTION AND BACKGROUND

This invention relates to wire tying tools and more particularly comprises a new and improved hand held assembly which is powered by an electric motor contained in the handle. The handle also contains rechargeable batteries for portable and safe operation of the tool.

Wire ties are extensively used both as bag ties and bar ties for such diverse purposes as binding sacks, linking snow fence slats, bundling rods and joining reinforcing rods. And a wide variety of tools are available for twisting the ties. These tools include very simple devices that have rigidly connected hooks and handles that are operated by turning the handle and more complex devices that include screw connections between the hooks and handles along with spring returns which enable the user to twist the wire by a pumping action on the handle. These devices are slow and require considerable work on the part of the user.

One important object of this invention is to provide an inexpensive, electrically powered, portable, light weight and safe hand tool which will reduce the manual labor and time involved in tying metallic bag ties and bar ties.

Another object of this invention is to provide an automatic tool which will make tighter and more uniform twists in the wire ties to which it is applied than can be obtained by the various manually operated tying tools presently available.

Still another object of this invention is to provide a wire tying tool whose power is available only when it is properly engaged with a tie.

To accomplish these and other objects, the automatic tying tool of this invention has among its many features a hook positioned on a shank which protrudes from the head of the handle and which is axially connected to the shaft of the electric motor located within the handle. The electric motor and the attached shank and hook are urged rearwardly in the handle by a spring located forward of the motor in the handle. When the hook engages a tie and a pulling force away from the wire is applied to the handle, the spring is compressed and the motor takes up a more forward position within the handle. This relative displacement of the handle and the motor activates a switch capable of closing the motor circuit. In this configuration, the tool can operate only when the hook is engaged in a tie and the handle is being drawn away from the wire. When activated in that manner, the motor causes the hook to rotate, thus tightly twisting the connected wire tie.

In order to increase the safety and life of the tool, a second, manual, on-off switch is provided in series with the switch actuated by relative displacement of the motor and handle.

For convenience and portability the tool is powered by rechargeable batteries housed in the handle; these batteries are recharged through an external socket placed in the rear of the handle in order not to hinder secure gripping of the handle by an operator.

These and other objects and features of this invention will be better understood and appreciated from the following detailed description of one embodiment thereof, selected for purposes of illustration and shown in the accompanying drawing, in which:

BRIEF FIGURE DESCRIPTION

DETAILED DESCRIPTION

Figure 1:
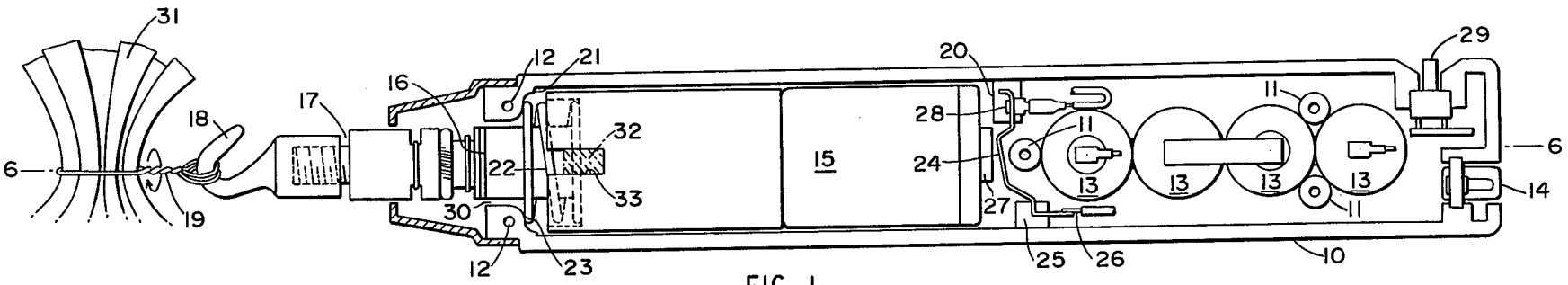
FIG. 1 is a top view of a tool constructed in accordance with this invention with the top half of the handle removed in order to display details of the assembly.

The electrically powered hand held wire tying assembly shown in FIG. 1 includes in its generally organization a handle 10 of which only the lower portion is shown. The top part of the handle is attached to the lower half by screws fastening into elevated posts 11 and into threaded holes 12 in the front end of the handle. The four series connected rechargeable batteries 13 powering the system are located in the rear half of the handle; these batteries are appropriately wired to an external socket 14 for easy recharging.

The D.C. motor 15, with its axis along the line 6—6, is located in the forward half of the handle, and connected to its shaft 16 is a shank 17 which emerges through the opening 30 from the front of the handle. A hook 18 is fastened onto the front end of the shank as shown in FIG. 1. In operation the motor 15, through the interconnecting shank, turns the hook which, when engaged with a wire tie 19, twists it tightly and uniformly to close the bag 31 securely. This wire tying tool may be used not only as shown for bag ties, but among other things, also to fasten bar ties, bundling ties and snow fence ties as well.

The motor 15, which is prevented from rotating by the fragmentarily displayed lug 32 protruding from the handle and fitting into the slot 33 in the motor casing, can be displaced back and forth within the handle along the line 6-6. The motor is restrained in the rear by a restraint 20 in the handle and in the front by the front of the handle at position 21. When the hook 18 is not engaged and the handle 10 is not pulled back, a spring 22, in contact with the front of the handle at position 23 and the front end of motor casing, maintains the motor in its most rearward position, in contact with the rear restraint 20.

Figure 3:
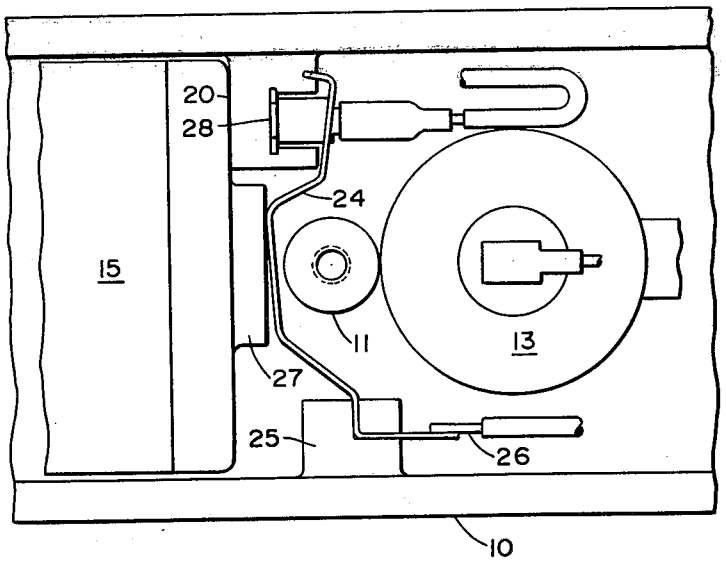
FIG. 3 is a fragmentary view similar to FIG. 2 but showing the motor in its rearward (or biased) position and the pull switch in its off position.
Figure 2:
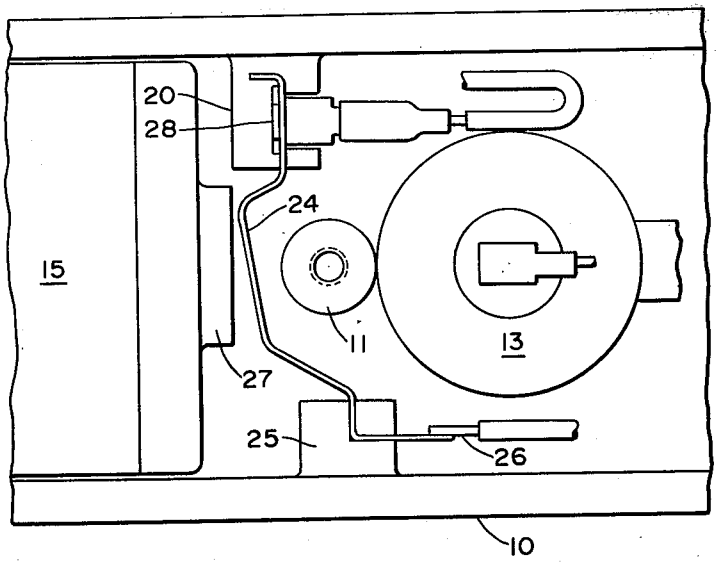
FIG. 2 is an enlarged fragmentary top view of the assembly of FIG. 1, showing the motor in its forward position and the pull operated switch in its on position.

When the hook is engaged and the handle pulled back, the handle slides back so that the motor is no longer in contact with rear restraint 20. In this configuration, the spring 22 is compressed so that when the rearward pulling force is no longer applied to the handle, the handle is drawn forward and the rear of the motor reengages the restraint 20. FIGS. 1 and 2 show the motor forward in the handle and not in contact with restraint 20, while FIG. 3 shows the motor in its non-operating condition back against that restraint.

The assembly has two switches: the first of these, a pull switch, involves the electrically conducting metallic formed strip 24 which is rigidly embedded at one end in a protrusion 25 in the lower half of the handle, and which is in rigid electrical contact with the circuit on the same end through the lead 26. When the motor is in its rearmost condition up against the restraint 20, the insulated protrusion 27 in the back of the motor is in contact with the formed strip 24 elastically bending it back to the flexed position shown in FIG. 3. When the motor 15 is in its forward position in the handle (as it is when the hook is engaged and the handle is pulled back), as shown in FIGS. 1 and 2, the strip 24, being no longer in contact with the protrusion 27, unflexes until it makes contact with the vertically deployed lead 28 and thereby closes this part of the circuit. As designed, this first switching mechanism only allows operation of the motor when the latter is in its forward position in the handle: the hook is, therefore, turned only when it is engaged in a tie and the handle pulled back.

The second switching mechanism 29, located for manual operation in the side of the handle 10 at the rear is wired in series with the batteries, motor and first switching mechanism. This switching mechanism is left in its off position when the tool is not in use. In this configuration, the circuit is open and unsafe accidental operation is prevented even when the hook 18 is pulled out from the handle. When the manual switch is in its on position, the tool functions as described above when the pull switch is activated.

Because the torque applied to the hook 18 is determined by the properties of the motor 15, wire ties 19 are twisted more uniformly, more tightly and with less fatigue to the operator than any presently known manually operated tying device. These features make this labor saving automatic tie twisting tool especially attractive for such uses as fastening bag ties, tying together structural bars, fastening bundling ties and tying snow fences, etc.

From the foregoing description, it will be appreciated that the several objectives set forth in the introduction of this application are accomplished by this invention. It should be noted that the description above only refers to one of many possible embodiments of this invention.

What is claimed is:

1. An electrically powered hand held wire tying assembly comprising a handle adapted to be held by an operator, an electric motor non-rotatably seated within said handle, said motor having a shaft oriented with its axis extending from the rear to the front of said handle, said handle having a forward opening providing direct access to the shaft of said motor, a hook rotatably interconnected with said shaft of said motor through said forward opening in said handle, a first electrical switching means contained in said handle which, when said hook is engaged and restrained from rearward motion, is activated by the application to said handle of a rearwardly directed force, said motor being so interconnected with said first switching means as to function only when said first switching means is activated, said first switching means being deactivated upon cessation of the application of said rearwardly directed force.

2. An electrically powered hand held wire tying assembly as described in claim 1 further characterized by said handle containing a battery electrically connected to and providing power for said motor.

3. An electrically powered hand held wire tying assembly as described in claim 2 further characterized by said battery being rechargeable, said handle containing means electrically connected to said battery so that it can be recharged by an electrical power source external to said assembly.

4. An electrically powered hand held wire tying assembly as described in claim 1 further characterized by said motor and hook being forwardly slidable with respect to said handle said handle containing a restraint which engages said motor and limits the rearward travel of said motor in said handle;

a spring in said handle and interconnected with the motor, yieldably biasing said motor and hook in a rearward direction with respect to said handle, against said restraint, said bias in said spring being overcome and said handle being rearwardly displaced by said rearwardly directed force, said motor and hook are thereby moved to their forwardmost positions with respect to said handle;

said first switching means being activated when said motor and hook are in their forwardmost position with respect to said handle, and being deactivated when said motor and hook are in their rearward most position.

5. An electrically powered hand held wire tying assembly as described in claim 4 further characterized by a second switching means on said handle, said motor being interconnected with said second switching means so as to function only when said first and second switching means are both activated, said second switching means being manually operated and so placed on said handle as to allow said manual operation from the outside of said handle.

6. An electrically powered hand held wire tying assembly as described in claim 5 further characterized by said handle containing a battery interconnected with said motor and said first and second switching means to provide electrical power for the operation of said motor.

7. An electrically powered hand held wire tying assembly as described in claim 6 further characterized by said battery being rechargeable, and said handle containing externally exposed means electrically connected to said battery whereby said battery can be recharged by an electrical power source external to said assembly.

8. An electrically powered hand held wire tying assembly as described in claim 7 further characterized by said handle being split longitudinally into first and second sections, said motor, battery, first and second switching means, hook, and recharging means being seated in said first section, and means retaining the two sections together, said means being removable so that said second section can be detached from the rest of said assembly.

* * * * *